US005265862A

United States Patent [19]

Jones et al.

[11] Patent Number: 5,265,862

[45] Date of Patent: Nov. 30, 1993

[54] SHEETER FOR RECYCLED AND LIGHTWEIGHT PAPER STOCKS

[75] Inventors: Donald A. Jones, Terre Haute; Paul D. White, Rosedale; Johnny L. Guess, Terre Haute, all of Ind.

[73] Assignee: Numerical Concepts, Inc., Terre Haute, Ind.

[21] Appl. No.: 951,575

[22] Filed: Sep. 25, 1992

[51] Int. Cl.[5] ..... B65H 29/68

[52] U.S. Cl. ..... 271/202; 271/202

[58] Field of Search ..... 271/182, 183, 202

[56] References Cited

U.S. PATENT DOCUMENTS

| | | | |
|---|---|---|---|
| 2,261,972 | 11/1941 | Matthews . | |
| 3,178,174 | 4/1965 | Schneider . | |
| 3,502,321 | 3/1970 | McWhorter . | |
| 3,507,489 | 4/1970 | Wilshin . | |
| 4,682,767 | 7/1987 | Littleton . | |
| 5,039,082 | 8/1991 | Littleton | 271/182 |
| 5,088,719 | 2/1992 | Kiyota | 271/182 |

*Primary Examiner*—Richard A. Schacher
*Attorney, Agent, or Firm*—H. John Barnett

[57] ABSTRACT

An improved slow down system in sheet handling equipment which makes possible high speed handling of paper and plastic materials, including limp-bodied paper and plastic stocks, such as lightweight and recycled paper and plastic bags. In the prior high speed sheet handling systems, the slow down sections tend to jam because the limp-bodied sheets are easily deformed at higher speeds. A conventional snubber and a laydown device just following the high speed section of the sheet handling equipment lays down the trailing portion and edges of the first and successive incoming sheets, so that the lead edge of each successive sheet will clear all parts of the previous sheet. The sheets are squared by a tape slow down section, which comprises sets of adjustable slow down tapes with idler rollers and lower slow speed tapes with idler rollers, all running at the same speed. The idler rollers are adjustable so that the optimum stream can be obtained for any limp-bodied or lightweight sheets.

10 Claims, 6 Drawing Sheets

SHEETER FOR RECYCLED AND LIGHTWEIGHT PAPER STOCKS

BACKGROUND OF THE INVENTION

1. Field of the Invention

This invention relates to paper sheeters and delivery equipment used in a high speed web printing press operation, particularly to such equipment used for handling lightweight and recycled paper stocks which are relatively limp. The sheets must be decelerated after leaving the high speed section of the apparatus.

2. Description of the Related Art

The following patents describe various types of sheet feeding equipment:

| Patent Number | Inventor | Date |
|---|---|---|
| 2,261,972 | Matthews | 1941 |
| 3,178,174 | Schneider | 1965 |
| 3,502,321 | McWhorter | 1970 |
| 3,507,489 | Wilshin, et al | 1970 |
| 3,994,221 | Littleton | 1976 |
| 4,682,767 | Littleton | 1987 |
| U.K. 1,158,844 | E. C. H. Will | 1969 |

Matthews '972 describes upper and lower rollers 19 and 39, best seen in FIG. 8 which deflect the incoming sheets 56 to provide a soft means for stopping the high speed travel of the sheet. This apparatus worked well for sheet stock having good body, but jams when lightweight or recycled paper sheets are fed through.

Schneider '174 obtains a braking effect in his apparatus by means of a compressed air nozzle, or a press-down component, and suction device or brake bands which act together on the rear end of the sheet. McWhorter '321 describes a collating machine which transfers sheets from a high speed section to a low speed section. Braking of the overlapped, stacked sheets is effected by a series of nip assemblies which include a back-up roller and an upper roller and a belt nip assembly. When lightweight or limp-bodied paper (recycled paper) is fed through such a slow down system, the trailing edges of the sheets tend to curve up and jam.

British Patent 1,158,844 shows an intermittently operated belt-retarder which travels more slowly than the conveyor belt and the rear end of each incoming sheet is pressed and retarded by a segment on a rotor. Again, the system does not work as well with limp-bodied sheets because they tend to curl at the outside trailing edges, and interfere with the next incoming sheet.

Wilshin et al '489 describes a slow down system for a sheet feeding apparatus which employs a reciprocating roller which is synchronized to only contact the incoming sheets at their trailing edge as the trailing portion of each sheet is passing the roller. This system was satisfactory at lower speeds for sheets having body, but limp or lightweight sheets tend to curl at the outside trailing edges, and the leading edge of the next incoming sheet tends to jam against the rear of the first sheet.

Littleton '221 describes a slow down system incorporating rotary snubbers (knockdown arms) which cooperate with squaring rollers to insure shingling of the sheets as they are decelerated on the second, lower speed conveyor. The rotary snubbers act on the middle of trailing portion of the sheets so when limp-bodied sheets are handled, the outside trailing portions tend to curl and jam against the next incoming sheet.

Littleton '767 describes a snubber means which cooperates with a deck plate to slow the sheets coming from the high speed section of a sheet handling system. The snubber contacts the trailing portion of each incoming sheet. The same problem occurs with this system when limp-bodied sheets are handled. The outside trailing portions of the sheets tend to curl up and cause the next incoming sheet to jam.

SUMMARY OF THE INVENTION

The subject invention is directed to an improved slow down system in sheet handling equipment which makes possible high speed handling of limp-bodied paper stocks, such as lightweight paper and also recycled paper, in which the cellulose fibers are much shorter and contribute little stiffness to the sheets. In the prior high speed sheet handling systems, the slow down sections tend to jam because the limp-bodied sheets are easily deformed at higher speeds.

This invention combines a conventional snubber and a laydown device just following the high speed section of the sheet handling equipment. The laydown device lays down the trailing portion and the tail corner edges of the first and successive incoming sheets, so that the lead edge of each successive sheet will clear all parts of the previous sheet.

The snubber slows the sheet by making contact with the trailing portion, but since the sheets are limp-bodied, the trailing portion including the outside corners tend to curl up against the upper high speed tape, and do not get out of the way of successive sheets, causing jam ups. The laydown prevents this.

The sheets are squared by a tape slow down section, instead of with squaring rollers. While the snubber is gripping the tail edge of a sheet, the leading edge of the sheet enters the squaring section. This section comprises sets of upper slow down tapes and two idler rollers per tape and lower slow speed tapes with one idler roller per tape, all running at the same speed. A variable throat is defined by the two upper slow down idler rollers acting on the upper slow down tapes and the lower slow down idler roller acting on the lower slow speed tapes. The sheet passing through the tape slow down section describes a flattened "S" wrap, which squeezes out the air between the incoming sheet and the prior overlapped sheets to establish a more uniform stream without buckling the limp-bodied sheets. The idler rollers are adjustable so that the optimum stream can be obtained for any limp-bodied or lightweight sheets.

DETAILED DESCRIPTION OF THE INVENTION

Figure 1:
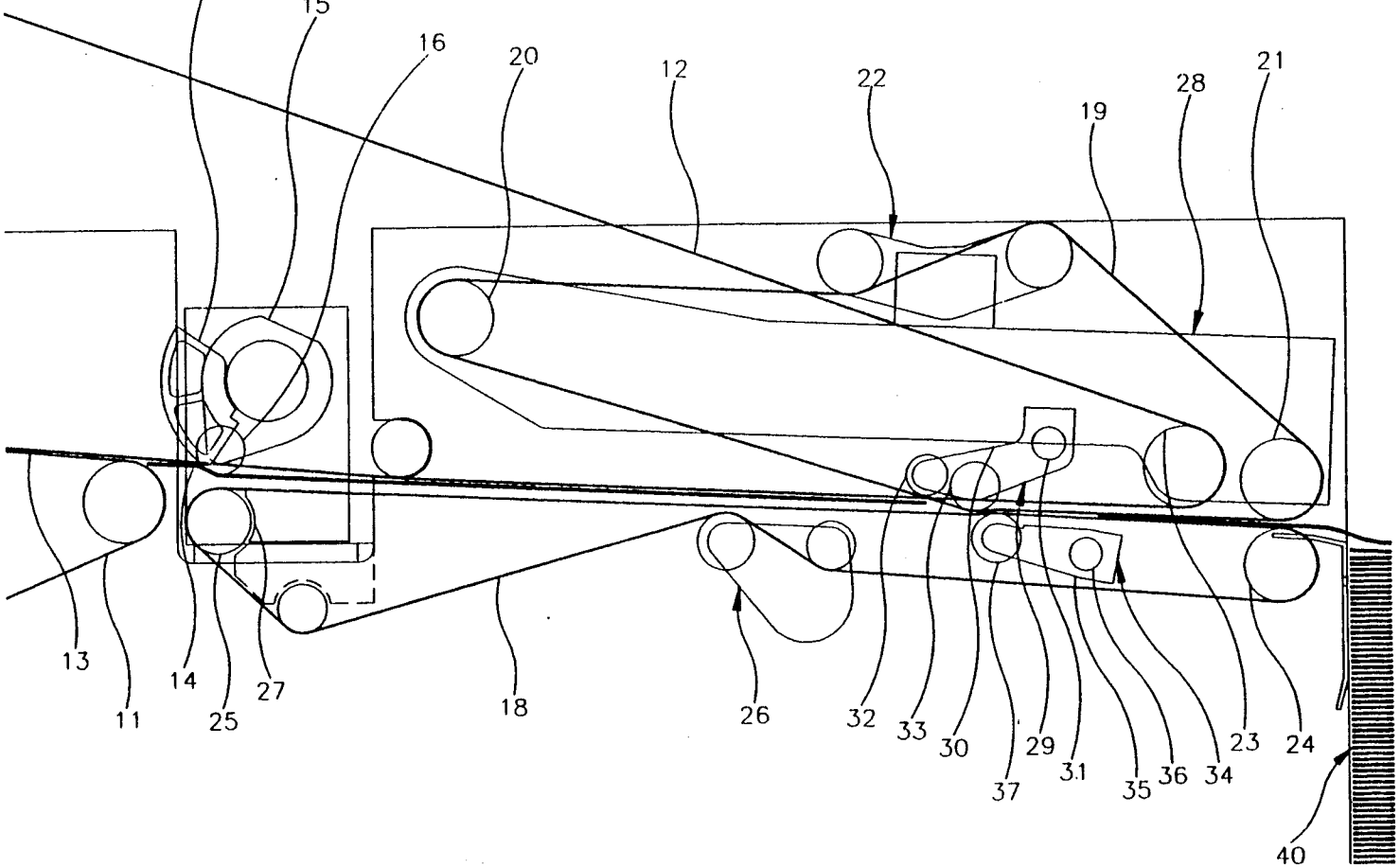
FIG. 1 is a side schematic view of the slow speed section of a paper sheet or signature handling equipment showing the tail end of the sheet just leaving the high speed section.

As seen in FIG. 1 of the drawings, the high to slow speed section of a sheet, signature or paper web converter system includes lower high speed tapes 11, upper high speed tapes 12 which feed a following sheet 13 downstream towards the slow speed section, which already contains a first sheet 14. The trailing edge 14*b* of the first sheet 14 is shown passing under rotatable snubber holders 15 which carry snubber wheels 16 and laydowns 17.

Lower slow speed tapes 18 are disposed below the snubber holders 15, and extend generally horizontally downstream under the first sheet 14. Upper slow speed tapes 19 are disposed above lower slow speed tapes 18 and are disposed parallel to the low speed tapes 18 for about the last third of their downstream, horizontal run.

Upper slow speed drive roll 20 provides a pivotable support for the upstream end of upper slow speed tapes 19. Drive roll 20 is spaced above the upstream end of the generally horizontal portion of the lower slow speed tapes 18. Upper slow speed tapes 19 are also supported at the downstream end by upper slow speed idler roll 21. A conventional tape tension assembly 22 is disposed between idler roll 21 and upper slow speed drive roll 20 on the upper run of the tapes 19 to keep a constant tension on tapes 19.

Upper high speed tape idler roller 23 is disposed just horizontally upstream from upper slow speed idler roller 21 and supports the downstream ends of the upper high speed tapes 12, which run generally horizontally downstream from the high speed section of the paper web converter system, under the snubber holders 15 and on to the idler roller 23 where tapes 12 reverse direction up and away from the slow speed section to return to the high speed section of the paper web converter system.

Lower slow speed idler roll 25 is disposed just before and below the snubber holders 15, and urges the lower low speed tapes 18 to the most upstream point of travel. A conventional lower slow speed tape tension assembly 26 is disposed intermediate the lower, slow speed drive roll 24 and the lower, slow speed idler roll 25. The tape tension assembly 26 can be adjusted to maintain the desired tension on the tapes 18.

A snubber plate 27 is provided directly below the snubber holders 15, and provides a horizontal surface to limit the downward pushing of the snubber wheels 16 on the first sheet 14, second sheet 13 against the lower, slow speed tapes 18. The snubber wheels 16 and snubber plate 27 pinch the trailing portion of the sheet against the lower slow speed tapes 18 to slow down the sheet.

Arm assembly 28 in the slow down section is pivotably supported by the upper slow speed drive roll 20 at the upstream end. The upper high speed idler roll 23 and the upper, slow speed idler roll 21 are rotatably supported on the downstream end of the arm assembly 28 and can be adjusted vertically by pivoting the arm assembly 28 at the upper slow speed drive roll 20.

Upper slow speed tape throat regulator assembly 29 is disposed near the downstream end of the slow down section of the improved paper converter system. Regulator assembly 29 includes J-arm 30, J-arm pivot 31, J-arm entry roller 32, and J-arm nip roller 33. The main function of throat regulator assembly 29 is to contact the front portion of the sheet 14, and subsequent sheets to cooperate with the snubber wheels 16 to assist slow down and squaring the sheet 14, and all successive sheets. The lower nip assembly 34 can also be adjusted to the most desirable position to provide the most optimum slow down and squaring effect on the sheet 14, and successive sheets.

The arm 35 of the lower nip assembly 34 turns about pivot 36 and supports a plurality of lower nip rollers 37 disposed across the lower tapes 18 to form a flattened "S" wrap in the leading portion of the sheet 14. Both the upper slow speed tape throat regulator assembly 29 and the lower nip assembly 34 are adjustable to obtain the most effective squaring and smoothing action on sheet 14 and subsequent sheets.

The operation of the snubber wheels 16, the laydown 17, the throat assembly 29 and the nip roller assembly 34 is described below. Initially, the snubber wheels 16 knock down the trailing portion of the first sheet 14 as it leaves the lower high speed tapes 11 to separate it from the upper high speed tapes 12. The initial knockdown action of the snubber wheels 16 tends to allow the remaining trailing portion of first sheet 14 to stay up, or in contact with the upper high speed tapes 12.

Figure 2:
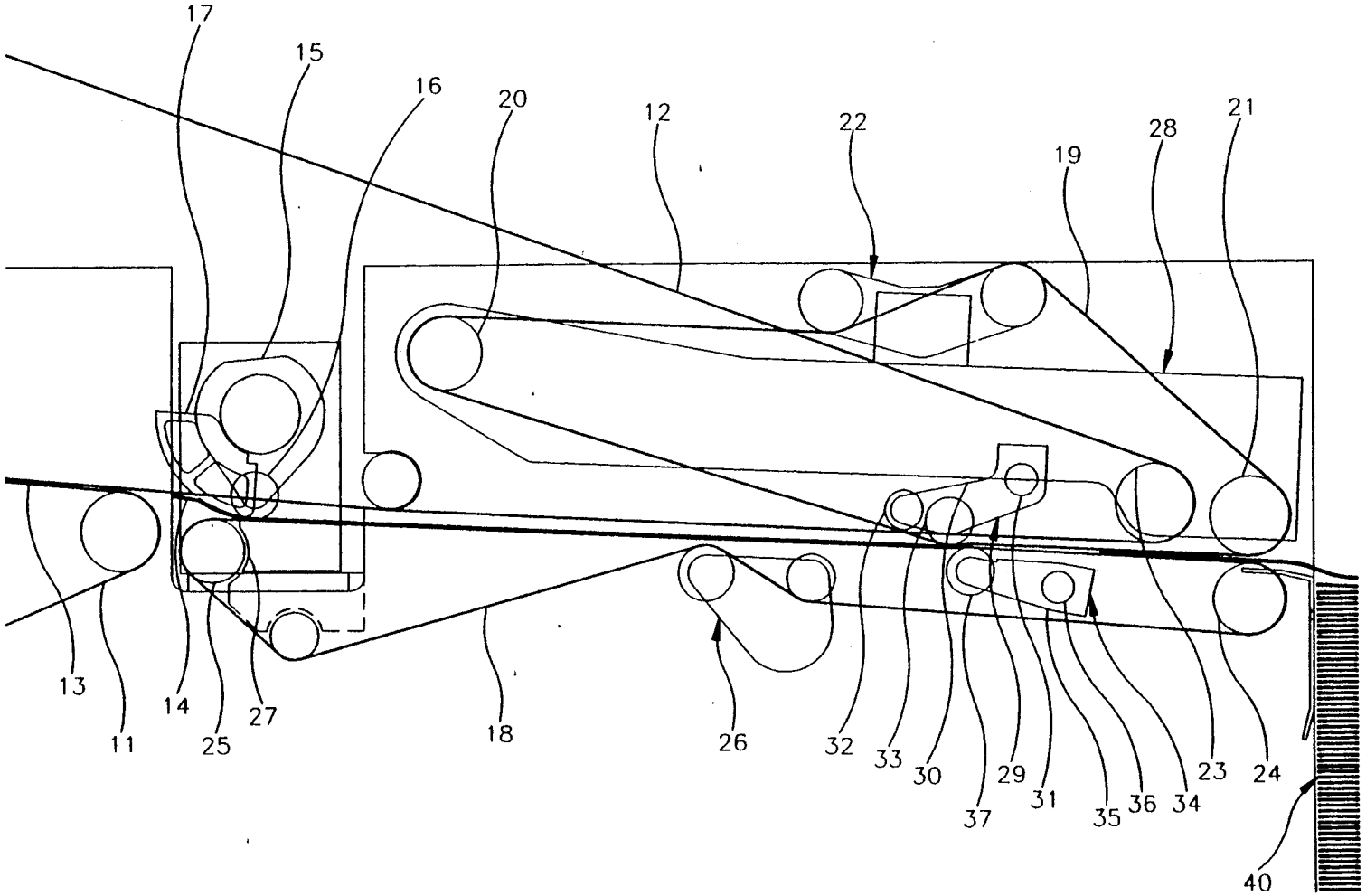
FIG. 2 is similar to FIG. 1, but showing the leading edge of the sheet entering the nip roll assembly, the trailing edge being snubbed and slowed down to the speed of the slow speed tapes, and also showing the laydown in contact with the trailing edge of the sheet.
Figure 3:
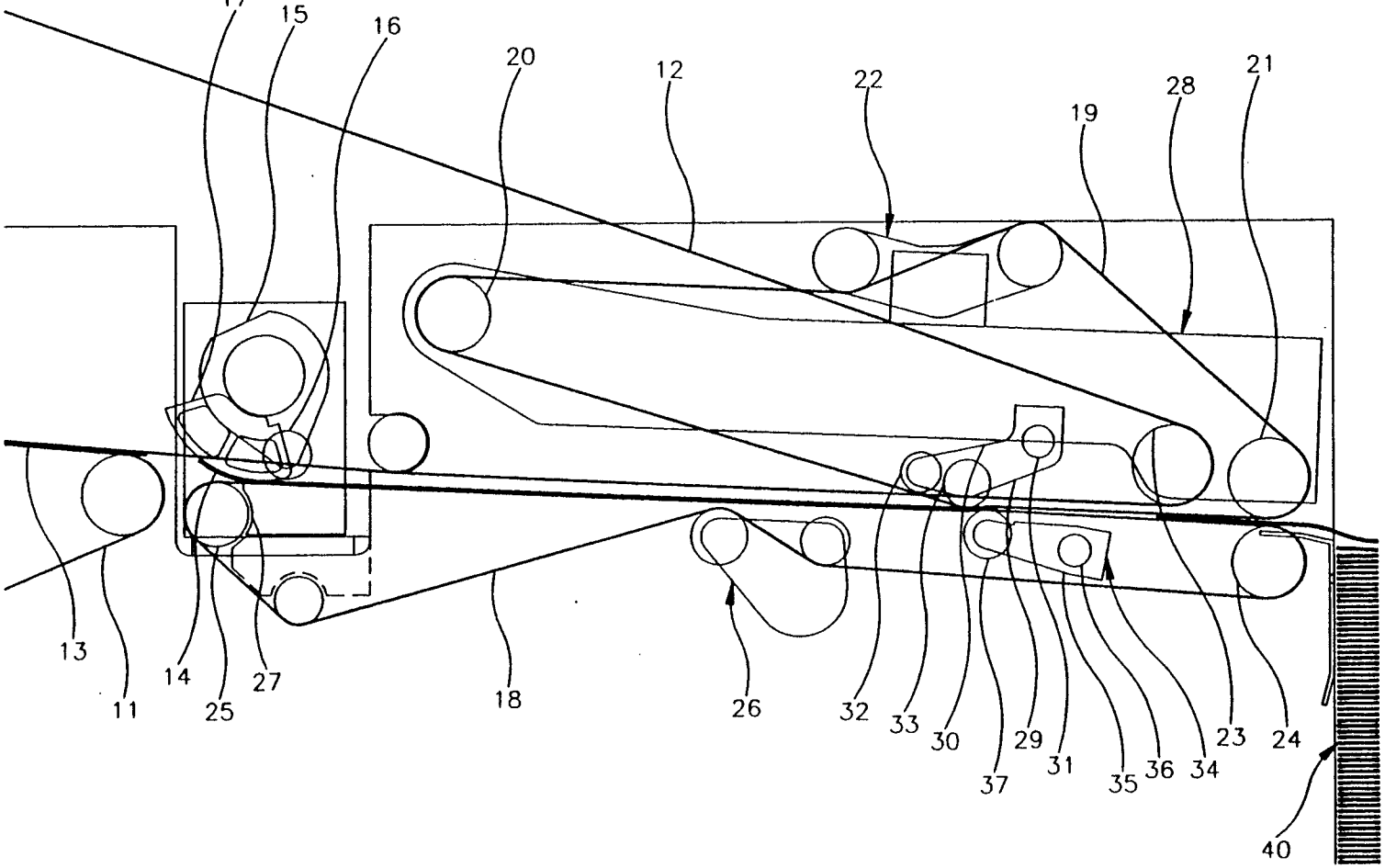
FIG. 3 is similar to FIG. 1, but showing the leading edge of the sheet past the nip roll assembly and the trailing edge of the sheet during the laydown action.
Figure 4:
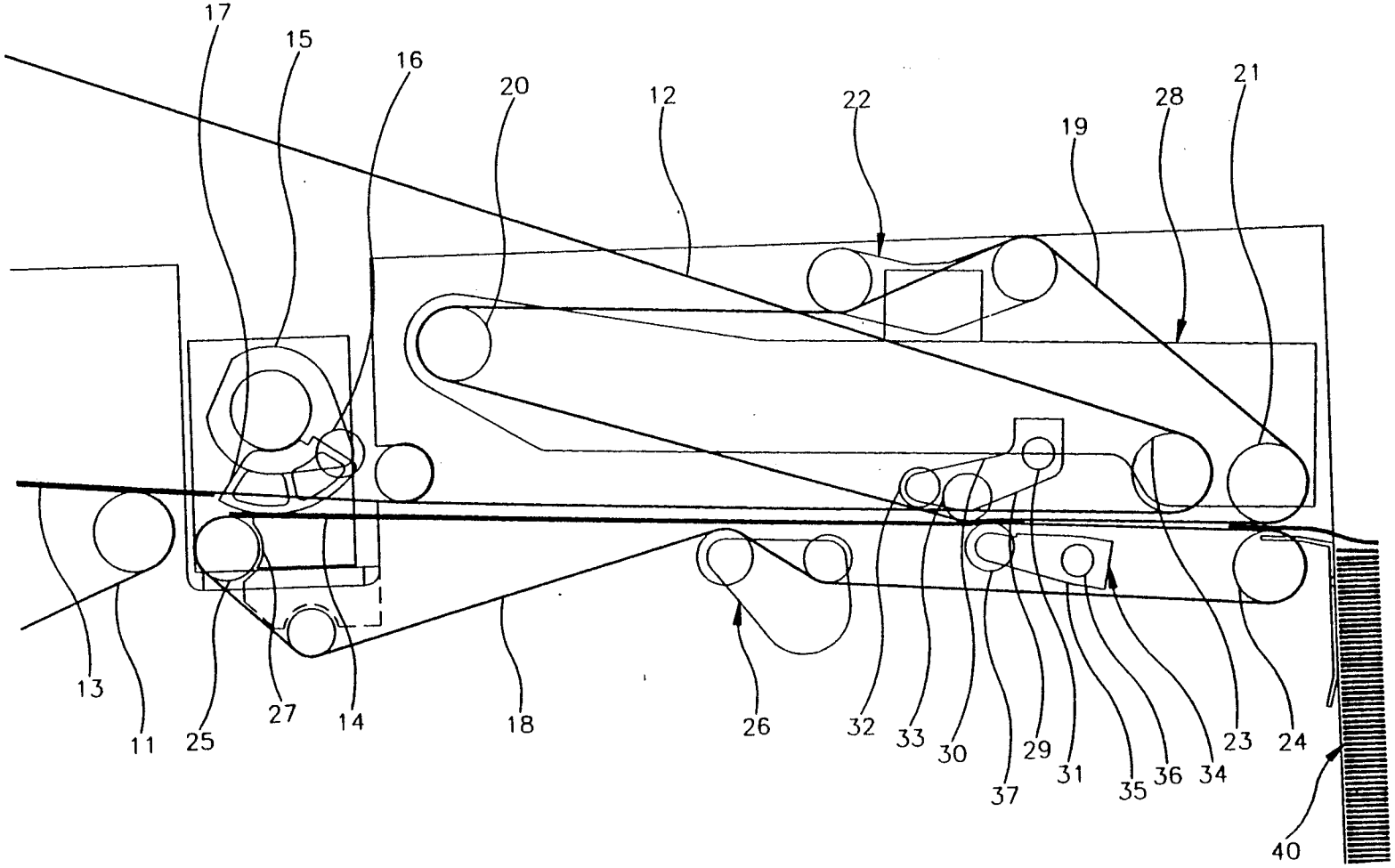
FIG. 4 is similar to FIG. 1, but showing the leading edge of the sheet well past the nip roll assembly, and the trailing edge of the sheet completely transferred to the lower slow speed tapes, and completely transferred below the leading edge of the next incoming sheet just prior to repeating the cycle.
Figure 5:
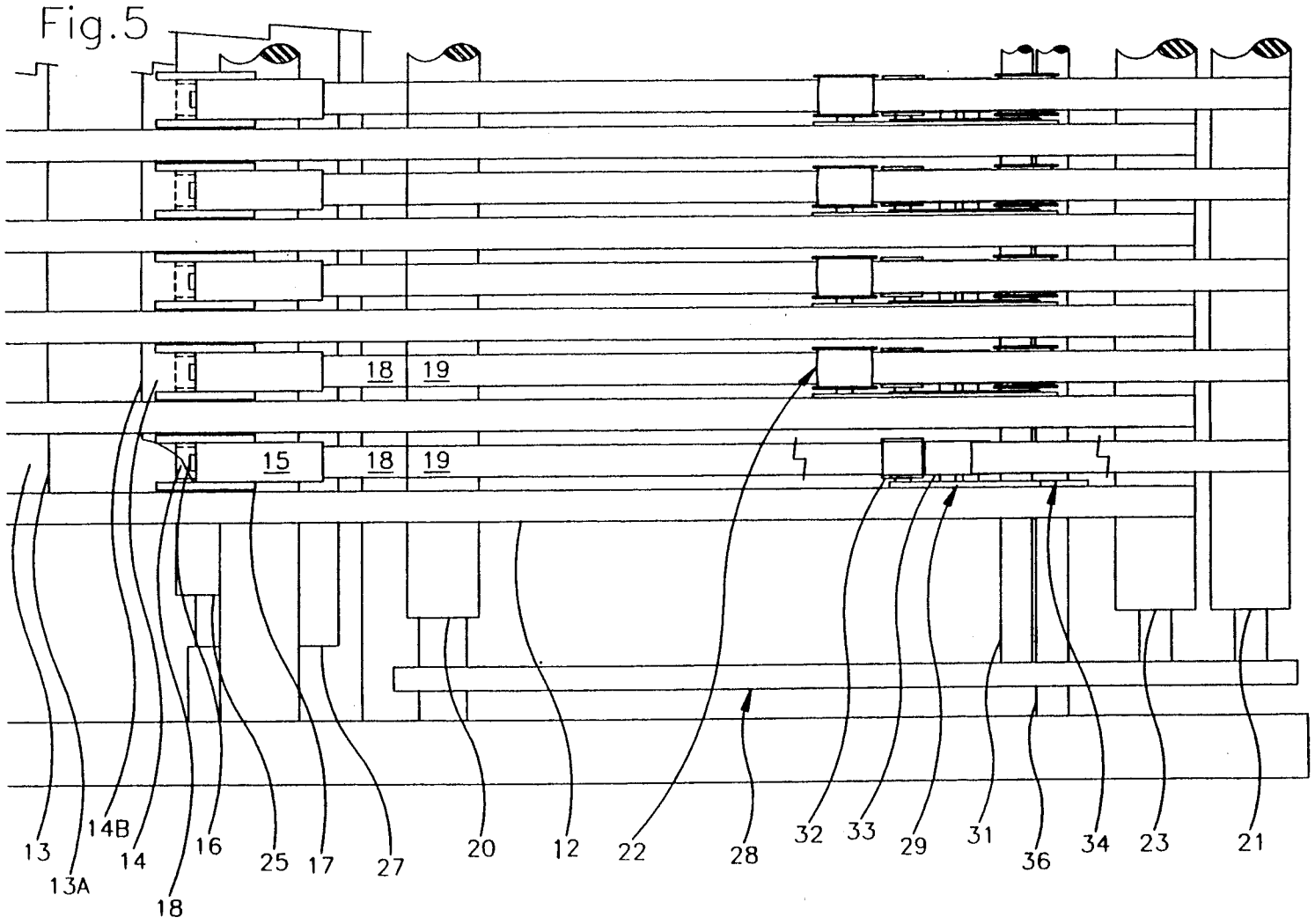
FIG. 5 is a schematic top plan view of the apparatus shown in FIG. 1 with some parts broken away and some omitted for clarity showing the positions of the snubbers and the laydowns relative to the conveyor tapes.

At this time, the laydowns 17 come into contact with the upper side of the trailing portion of first sheet 14 and gently bring the trailing portion into contact with lower slow speed tapes 18, and out of the way of second sheet 13 as can best be seen in FIGS. 2, 3 and 4.

As the sheet 14 is first contacted by the snubber wheels 16, the leading portion of the sheet 14 has not yet made contact with the upper, slow speed tapes 19 pinch point (FIG. 1). As seen in FIG. 2, when the leading portion of sheet 14 has contacted or nearly contacted the upper, slow speed tapes 19, the snubber wheels 16 are in the lowest position to produce the maximum braking effect on the sheet 14. At this time, the laydowns 17 have made contact with the trailing portion of sheet 14, and gently urge it towards the top side of the lower slow speed tapes 18.

FIG. 3 of the drawings shows that the leading edge of the first sheet 14 has passed beyond the lower nip rollers 37. Meantime, the laydowns 17 have almost completed the gentle laydown of the trailing portion of the first sheet 14 so that sheet 14 is completely separated from the upper high speed tapes 12, and is traveling at slow speed to permit shingling with the second sheet 13, and successive incoming sheets.

FIG. 4 shows that the leading portion of the first sheet 14 has moved even further downstream from the nip rollers 37, and the trailing portion of sheet 14 has moved downstream from the laydowns 17 and is in complete contact with the lower low speed tapes 18 and moving at the slower rate. The second sheet 13 is shown just ready to enter the slow speed section of the paper converter system. As can be seen in FIG. 4, the leading portion of the second sheet 13 will "catch up" with the following portion of the first sheet 14 and overlap it in a shingled effect to facilitate stacking of the sheets 14, 13 and successive incoming sheets.

Figure 6:
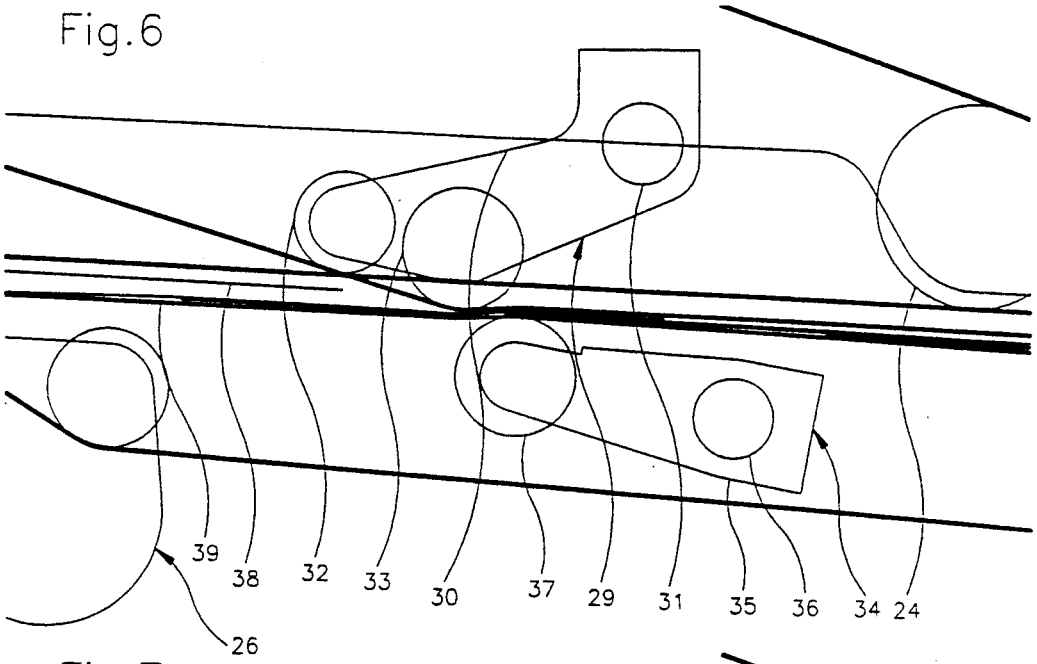
FIG. 6 is an enlarged detail of the nip roller assembly showing the shingling effect of the slow speed section of the sheet or signature handling equipment, corresponding to FIG. 1.
Figure 7:
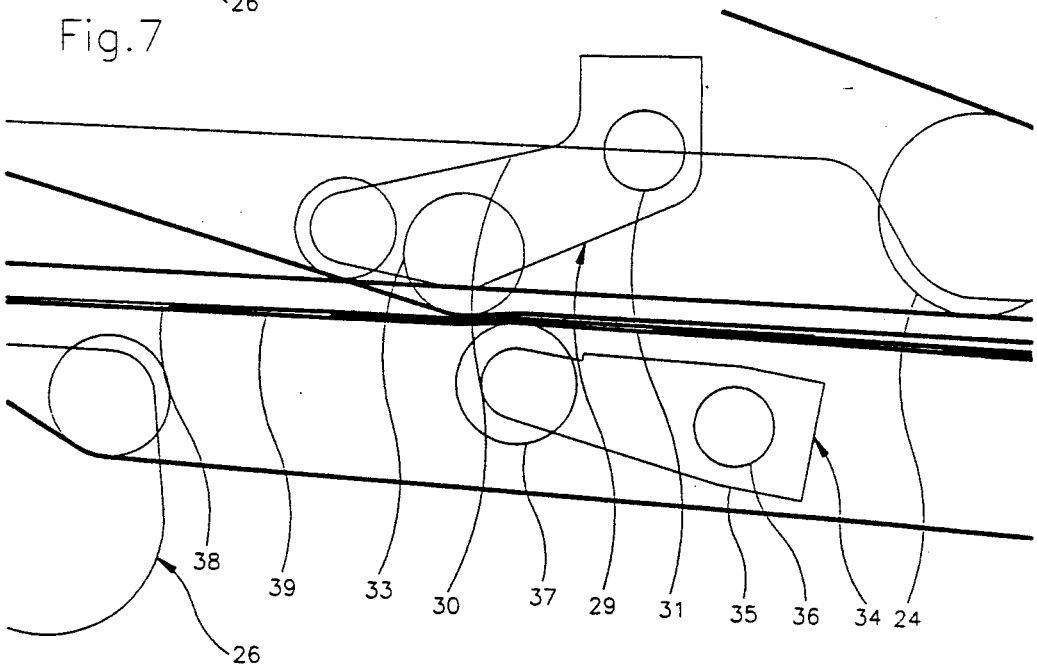
FIG. 7 is an enlarged detail similar to FIG. 5 with the sheet advanced further, corresponding to FIG. 2.

FIGS. 6 and 7 show the J-arm nip rollers 33 and the lower nip rollers 37 acting on the tapes 19 and lower slow speed tapes 18, respectively, to smooth and square the sheets. FIG. 6 shows an upper sheet 38 just before passing under the J-arm nip rollers 37, above the lower sheets 39, which have already passed between the J-arm nip rollers 33 and the lower nip rollers 37. There is still a layer of air between sheet 38 and lower sheets 39. As shown in FIG. 7, the sheet 38 is urged down on top of the sheets 39 to smooth out the layer of air, and continue the shingling effect and prepare the sheets 38 and 39 for the stacker 40.

In the above detailed description, the term "sheet" encompasses signatures, folded signatures and all cut units of flat paper-like consistency. In particular, this invention has application to the slow-down section of equipment for handling limp-bodied materials such as recycled paper, lightweight paper, and plastics.

We have found that the combination of components described above has substantially improved the effectiveness of the slow speed section of paper and plastic sheet handling equipment without jamming or otherwise fouling the equipment. Without the improved system, the high speed section could not exceed speeds of about 1500 feet per minute in best conditions. The improved system operates successfully with a high speed section at greater than about 2300 feet per minute.

What is claimed is:

1. In a sheet or signature handling system for paper or plastic sheets or signatures having leading and trailing edges, including lightweight and limp-bodied paper stock, a one-stage slow down section for receiving successive sheets or signatures traveling at high speeds comprising in combination:

a plurality of snubber assemblies rotatably disposed at the upstream end of the one-stage slow down section of the system;

a plurality of laydown members disposed on the periphery of the snubber assemblies;

a plurality of upper high speed tapes disposed adjacent the snubber assemblies and the laydown members, said tapes having a horizontal length extending downstream from the snubber assemblies in excess of the length of a sheet or signature;

a plurality of lower, one-stage slow speed tapes disposed below the snubber assemblies and the laydown members and having a horizontal length extending downstream beyond the downstream end of the upper high speed tapes;

a plurality of upper, one-stage slow speed tapes having a horizontal length disposed just above the downstream end of the horizontal length of the lower, one-stage slow speed tapes, and overlapping the downstream end of the horizontal length of the upper, high speed tapes; and a plurality of snubber members mounted on the snubber assemblies for contacting and knocking down the upper side of the trailing edge of an incoming sheet or signature in cooperation with the laydown members which contact the trailing edge after the snubbing members to transfer the successive incoming sheets or signatures directly from the upper high speed tapes to the lower, slow speed tapes while shingling the successive incoming sheets or signatures and slowing their speed to the speed of the low speed tapes without jamming or fouling the sheets or signatures.

2. The apparatus of claim 1, including a sheet or signature squaring apparatus downstream from the snubber assemblies and the laydown members at a distance less than the length of the sheet or signature.

3. The apparatus of claim 2, in which the squaring section comprises adjustable upper and lower nip rollers which deform the upper and lower low speed tapes and the shingled sheets traveling therebetween to smooth out and square the shingled sheets.

4. The apparatus of claim 3, in which adjustable upper and lower nip rollers cause the upper and lower tapes to deform the shingled sheets into a flattened "S" curve when viewed from the side.

5. The apparatus of claim 1, in which the snubber members include snubber rolls which engage the trailing portion of the sheet or signature to push it down and away from the upper, high speed tapes towards the lower, low speed tapes.

6. The apparatus of claim 5, including a snubber plate disposed beneath the upper, horizontal run of the lower, low speed tapes to limit the downward flexing of the lower, low speed tapes so that the sheets or signatures are pinched between the snubber rolls and the horizontal run of the lower low speed tapes.

7. The apparatus of claim 1, in which the laydown members each have an arcuate outer surface secured to the snubber holder which rotates around the periphery of the corresponding snubber holder immediately following the snubber rollers to lay down the trailing portion of the sheet to provide clearance for the next incoming sheet or signature.

8. The apparatus of claim 7, in which the laydown members have an arcuate outer surface of about ninety degrees.

9. An improved slow speed section for a sheet or signature handling system, particularly limp-bodied paper or plastic stock comprising:

a plurality of upper, high speed tapes for conveying successive sheets or signatures to the slow speed section of the system, said upper high speed tapes having a horizontal run extending most of the length of the slow speed section;

a plurality of lower, low speed tapes having a horizontal run extending the length of the slow speed section, and disposed adjacent and just below the horizontal run of the upper, high speed tapes to receive and transfer successive sheets or signatures from the upper high speed tapes to the lower, low speed tapes;

a plurality of upper, low speed tapes having a horizontal run extending over about one third of the downstream end of the horizontal run of the lower, low speed tapes, and overlapping the downstream end of the horizontal run of the upper high speed tapes for cooperating with the lower, low speed tapes to insure complete smoothing and squaring of successive sheets or signatures as they are transferred from the upper high speed tapes to the lower low speed tapes;

combination snubber and laydown assemblies, each including a rotatable snubber and laydown holder disposed at the upstream end of the slow down section just above the upstream end of the horizontal run of the lower low speed tapes;

a laydown member having an arcuate surface disposed on the outer periphery of each snubber and laydown assembly, said arcuate surface commencing just following the snubber roll and extending arcuately for about ninety degrees, whereby the upper surface of the trailing portion of successive sheets or signatures are first contacted by the snubber rolls to separate the trailing portions of the sheets or signatures from the upper high speed tapes and slow the sheets or signatures to the speed of the lower, low speed tapes, and the laydown members then contact the trailing portion of the sheets or signatures to provide positive clearance for the next sheet or signature entering the low speed section of the apparats; and a nip roller assembly for smoothing and squaring the sheets or signatures disposed downstream from the snubber and laydown assemblies at a distance just less than the length of the sheets or signatures.

10. The apparatus of claim 9, in which the laydown members each comprise a pair of arcuate segments disposed on the opposite sides of a segment of each of the combination snubber and laydown assemblies.

* * * * *